US008476520B2

(12) United States Patent
Usui et al.

(10) Patent No.: US 8,476,520 B2
(45) Date of Patent: Jul. 2, 2013

(54) SOUND GENERATION CONTROL APPARATUS

(75) Inventors: Jun Usui, Hamamatsu (JP); Taishi Kamiya, Tokyo (JP); Yoshihiro Katsumata, Hamamatsu (JP); Kiyohisa Sugii, Hamamatsu (JP); Thomas Coulbeaut, Fleron (BE)

(73) Assignee: Yamaha Corporation, Hamamatsu-shi (JP)

( * ) Notice: Subject to any disclaimer, the term of this patent is extended or adjusted under 35 U.S.C. 154(b) by 39 days.

(21) Appl. No.: 13/032,424

(22) Filed: Feb. 22, 2011

(65) Prior Publication Data

US 2011/0209597 A1 Sep. 1, 2011

(30) Foreign Application Priority Data

Feb. 23, 2010 (JP) ..... 2010-037619

(51) Int. Cl.
*G10H 1/18* (2006.01)

(52) U.S. Cl.
USPC ..... 84/615

(58) Field of Classification Search
USPC ..... 84/615
See application file for complete search history.

(56) References Cited

U.S. PATENT DOCUMENTS

2002/0176343 A1* 11/2002 Yamada et al. ..... 369/53.31
2004/0148575 A1* 7/2004 Haase ..... 715/528
2008/0264241 A1* 10/2008 Lemons ..... 84/601
2011/0094369 A1* 4/2011 Liu ..... 84/645

FOREIGN PATENT DOCUMENTS

JP 2003-108127 A 4/2003

* cited by examiner

*Primary Examiner* — Jianchun Qin
(74) *Attorney, Agent, or Firm* — Morrison & Foerster LLP

(57) ABSTRACT

A sound generation control apparatus displays in a loop region a music data image corresponding to music data to be generated as time progresses, such that progression of the music data corresponds to a lengthwise position of the loop region. The sound generation control apparatus outputs time information indicating the time that progresses from a start of generation of music sound. The sound generation control apparatus controls the generation of the music sound based on the music data according to a relationship between a lengthwise position of the loop region and a displayed location of the music data image in the loop region. The sound generation control apparatus displays a plurality of the music data images in the loop region, and simultaneously generates a plurality of music sounds corresponding to the plurality of the music data images as the time progresses.

20 Claims, 9 Drawing Sheets

SOUND GENERATION CONTROL APPARATUS

BACKGROUND OF THE INVENTION

1. Technical Field of the Invention

The present invention relates to a sound generation control apparatus.

2. Description of the Related Art

In a conventional music composition apparatus, a piece of music is composed by selecting desired data which specifies the content of music sound to be generated (hereinafter referred to as "sound generation data") from a plurality of sound generation data and by arranging the selected sound generation data in chronological order for generation of music sound of the sound generation data. Japanese Patent Application Publication No. 2003-108127 describes a technology in which a piece of music is composed by selecting a rhythmic pattern of one measure (i.e., a combination of sound generation data of one measure) on a pattern select screen and by arranging the selected rhythmic pattern on a pattern sequencer screen. Each rhythmic pattern is previously composed on a pattern edit screen.

Some music plays in a loop. This type of music is referred to as "loop music". A loop of music may be composed in the following manner. First, a plurality of music data, each including a plurality of sound generation data arranged in chronological order for generation of music sound of the sound generation data, are created. Then, the plurality of music data is edited (for example, the sound generation timings of the plurality of music data are changed) while repeatedly performing simultaneous sound generation of the plurality of music data, thereby composing the loop music. However, with the configuration of the music composition apparatus described in Japanese Patent Application Publication No. 2003-108127, it is difficult for a loop music composer to compose a desired loop of music while changing sound generation timings of a plurality of music data.

SUMMARY OF THE INVENTION

Therefore, it is an object of the invention to provide a sound generation control apparatus which allows the user to easily and visually identify relationships among a plurality of music data when repeatedly performing simultaneous sound generation of the plurality of music data.

To achieve the above object, the invention provides a sound generation control apparatus comprising: a display control unit that defines on a display device a loop region having an outer periphery surrounding a reference point and indicating progression of time in association with a length in a circumferential direction of the loop region, and that displays in the loop region a music data image corresponding to music data which specifies content of music sound to be generated as time progresses, wherein the music data image is displayed in the loop region such that progression of the music data corresponds to the length in the circumferential direction of the loop region; a time output unit that outputs, upon receiving an instruction to start generation of the music sound, time information indicating a time that progresses from a timing corresponding to the instruction; and a sound generation control unit that controls the content of the music sound to be generated by a sound generation device based on the music data corresponding to the music data image and according to a relationship between a position in the circumferential direction of the loop region determined by the time information outputted by the time output unit and a location of the music data image in the loop region, wherein the display control unit performs control operation for displaying a plurality of music data images in the loop region on the display device, and the sound generation control unit performs control operation for simultaneously generating a plurality of music sounds corresponding to the plurality of the music data images as the time progresses.

In the sound generation control apparatus, the display control unit may perform control operation for moving one or more of the plurality of the music data images in the circumferential direction of the loop region according to an instruction so as to change relative locations among the plurality of the music data images in the loop region.

The display control unit may include a zone specification unit that specifies a zone in the circumferential direction of the loop region, wherein the sound generation control unit changes the content of the music sound to be generated by the sound generation device when the position determined according to the time information is within the zone specified by the zone specification unit. Specifically, In the sound generation control apparatus, the display control unit may define a plurality of loop regions, and may display a plurality of the music data images in at least two of the plurality of the loop regions. Specifically, the display control unit defines the plurality of the loop regions arranged concentric with each other around the reference point common to the plurality of the loop regions.

Alternatively, the display control unit may define a loop region common to the plurality of the music data images, and may display the plurality of the music data images in the common loop region by different manners such that the plurality of the music data images are visually discriminated from each other.

Preferably, the display control unit defines a loop region having an annular shape geometrically symmetric with respect to the reference point.

Preferably, the display control unit displays an indicator which indicates the position in the circumferential direction of the loop region determined by the time information, such that the indicator travels in the circumferential direction of the loop region as the time progresses, and the sound generation control unit performs the control operation for generating the plurality of the music sounds in looping manner as the indicator travels cyclically through the loop region.

The invention further provides a method of controlling generation of music sounds with aide of a display device, the method comprising the steps of: defining on the display device a loop region having an outer periphery surrounding a reference point and indicating progression of time in association with a length in a circumferential direction of the loop region; displaying in the loop region a music data image corresponding to music data which specifies content of music sound to be generated as time progresses, wherein the music data image is displayed in the loop region such that progression of the music data corresponds to the length in the circumferential direction of the loop region; outputting, upon receiving an instruction to start generation of the music sound, time information indicating a time that progresses from a timing corresponding to the instruction; and generating the music sound based on the music data corresponding to the music data image and according to a relationship between a position in the circumferential direction of the loop region determined by the time information and a location of the music data image in the loop region, wherein the step of displaying displays a plurality of music data images in the loop region, and the step of generating simultaneously generates a plurality of music sounds corresponding to the plurality of the music data images as the time progresses.

The invention further provides a machine readable storage medium for use in a computer having a processor and a display device, the medium containing program instructions executable by the processor for controlling generation of music sounds with aide of the display device by processes of: defining on the display device a loop region having an outer periphery surrounding a reference point and indicating progression of time in association with a length in a circumferential direction of the loop region; displaying in the loop region a music data image corresponding to music data which specifies content of music sound to be generated as time progresses, wherein the music data image is displayed in the loop region such that progression of the music data corresponds to the length in the circumferential direction of the loop region; outputting, upon receiving an instruction to start generation of the music sound, time information indicating a time that progresses from a timing corresponding to the instruction; and generating the music sound based on the music data corresponding to the music data image and according to a relationship between a position in the circumferential direction of the loop region determined by the time information and a location of the music data image in the loop region, wherein the process of displaying displays a plurality of music data images in the loop region, and the process of generating simultaneously generates a plurality of music sounds corresponding to the plurality of the music data images as the time progresses.

According to the invention, it is possible to provide a sound generation control apparatus which allows the user to easily and visually identify relationships among a plurality of music data when repeatedly performing simultaneous sound generation of the plurality of music data.

DETAILED DESCRIPTION OF THE INVENTION

Embodiments

[Hardware Configuration]

Figure 1:
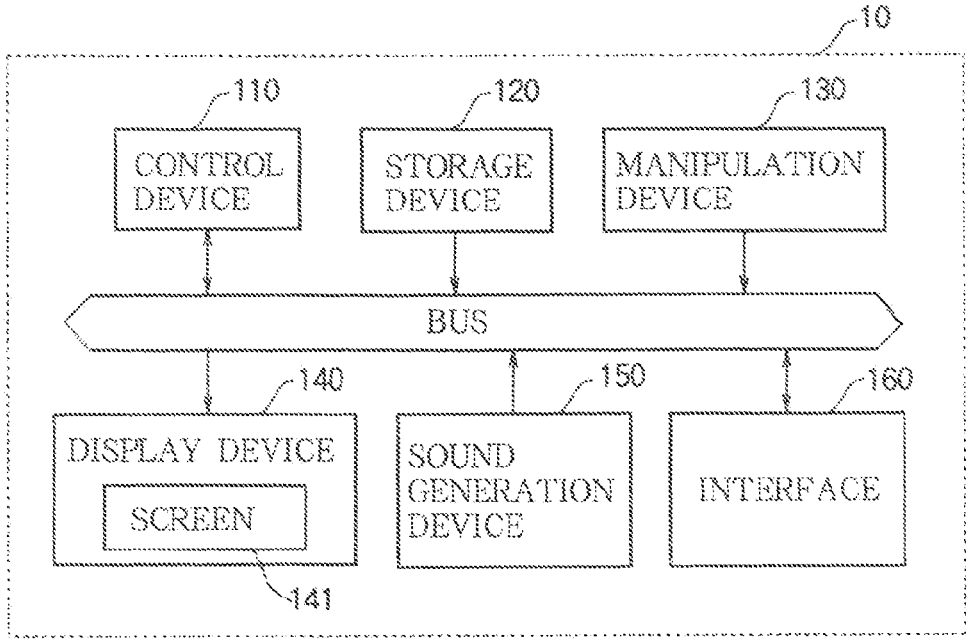
FIG. 1 is a block diagram illustrating a configuration of a sound generation control apparatus according to an embodiment of the invention.

FIG. 1 is a block diagram illustrating a configuration of a sound generation control apparatus 10 according to an embodiment of the invention. A control device 110 includes an arithmetic unit such as a Central Processing Unit (CPU) and a memory means such as a Random Access Memory (RAM) or a Read Only Memory (ROM). The CPU loads a sound generation control program stored in the ROM into the RAM and executes the sound generation control program to control components of the sound generation control apparatus 10 through a bus to implement various functions. The RAM functions as a work area when the CPU performs processing or the like on each piece of data. The control device 110 has a timer function to measure the time that progresses from a specific time, and controls the operations of the components of the sound generation control apparatus 10, which will be described later, according to the progressing time.

A storage device 120 is a storage means such as a nonvolatile memory and stores data (hereinafter referred to as "sound generation data") that specifies the content of a unit sound to be generated and music data that specifies the content of unit sound to be generated as time elapses. In this example, the sound generation data represents a waveform signal of musical sound of a predetermined time length (for example, several hundred milliseconds). The music data associates sound generation data with the timing of generation of a unit sound represented by the sound generation data. The storage device 120 stores image data representing images to be displayed and setting data associated with display of the images or sound generation. Instead of the ROM, the storage device 120 may also store the control program. The storage device 120 may also be a storage means such as an external nonvolatile memory connected to the sound generation control apparatus 10 through a connection interface.

A manipulation device 130 is a manipulation means such as a mouse, a keyboard, or a touch sensor through which the user performs a variety of manipulations on the sound generation control apparatus 10. The manipulation device 130 outputs information representing a manipulation performed through the manipulation device 130 to the control device 110.

A display device 140 is a display means such as a liquid crystal display including a screen 141 for displaying an image under control of the control device 110. A touch sensor is provided on a display portion of the screen 141 such that the screen 141 functions as a touch panel.

A sound generation device 150 is a sound generation means that includes a Digital Signal Processor (DSP), a speaker, and the like and performs sound generation under control of the control device 110.

An interface 160 is, for example, a connection terminal that is connected to an external device by wire, a wireless connection means that is wirelessly connected to the external device, or a communication means that is connected to the external device through a base station, a network, or the like, and transmits and receives a variety of data to and from the connected external device.

[Configuration of Sound Generation Control Function]

Next, a sound generation control function that the control device 110 implements by executing the sound generation control program is described below with reference to FIG. 2.

All or part of the components for implementing the sound generation control function described below may also be implemented by hardware.

Figure 2:
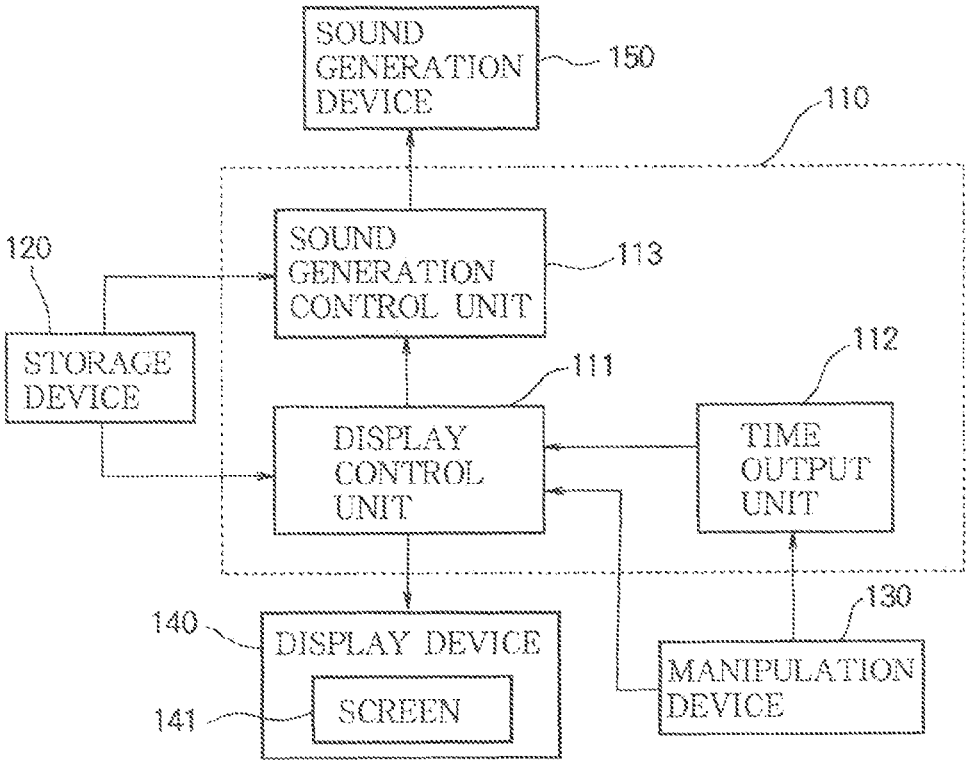
FIG. 2 is a block diagram illustrating a configuration of the sound generation control function.

FIG. 2 is a block diagram illustrating a configuration of the sound generation control function. The control device 110 constructs a display control unit 111, a time output unit 112, and a sound generation control unit 113 by executing the sound generation control program to implement the sound generation control function.

Upon receiving an instruction to start operation output from the manipulation device 130, the time output unit 112 generates time information representing a time that has elapsed from a time corresponding to the instruction. The time output unit 112 outputs the generated time information to the display control unit 111. For example, the time output unit 112 immediately generates time information upon receiving the instruction. The time output unit 112 may also receive an instruction to start operation from each component other than the manipulation device 130.

The display control unit 111 acquires image data of an image (hereinafter referred to as a "sequencer image") representing a sequencer used to reproduce music data from the storage device 120. The display control unit 111 acquires setting data of the position and direction of display of the sequencer image from the storage device 120. The display control unit 111 controls the display device 140 to display the sequencer image on the screen 141 using the acquired image data and setting data. The display control unit 111 acquires image data of an image (hereinafter referred to as a "sound generation data image") corresponding to sound generation data from the storage device 120 based on an instruction received from the manipulation device 130. In this example, the sound generation data image is an image corresponding to the name, feature, and the like of the sound generation data. The display control unit 111 acquires setting data of the position and direction of display of the sound generation data image from the storage device 120. The display control unit 111 controls the display device 140 to display the sound generation data image on the screen 141 using the acquired image data and setting data.

The display control unit 111 acquires image data of an image (hereinafter referred to as a "music data image") corresponding to music data based on an instruction received from the manipulation device 130. In this example, the music data image is an image corresponding to the content of music data. The display control unit 111 displays the music data image so as to superimpose on the sequencer image on the screen 141 based on the acquired image data and the setting data of the sequencer image. The display control unit 111 causes the screen 141 to display an image (hereinafter referred to as "sound generation indication image") indicating the position of sound generation based on time information received from the time output unit 112. The display control unit 111 outputs music data corresponding to the music data image and information of a position, at which sound generation of the music data starts, to the sound generation control unit 113 based on both the time information and a position at which the music data image is displayed. As a result, the display control unit 111 outputs information required for sound generation control to the sound generation control unit 113 according to a relationship between the positions at which the sound generation indication image and the music data image are displayed.

The sound generation control unit 113 acquires, from the storage device 120, sound generation data represented by the information acquired from the display control unit 111. The sound generation control unit 113 controls the sound generation device 150 to generate sound based on the acquired sound generation data.

[Configuration of Screen of Sound Generation Control Function]

Figure 3:
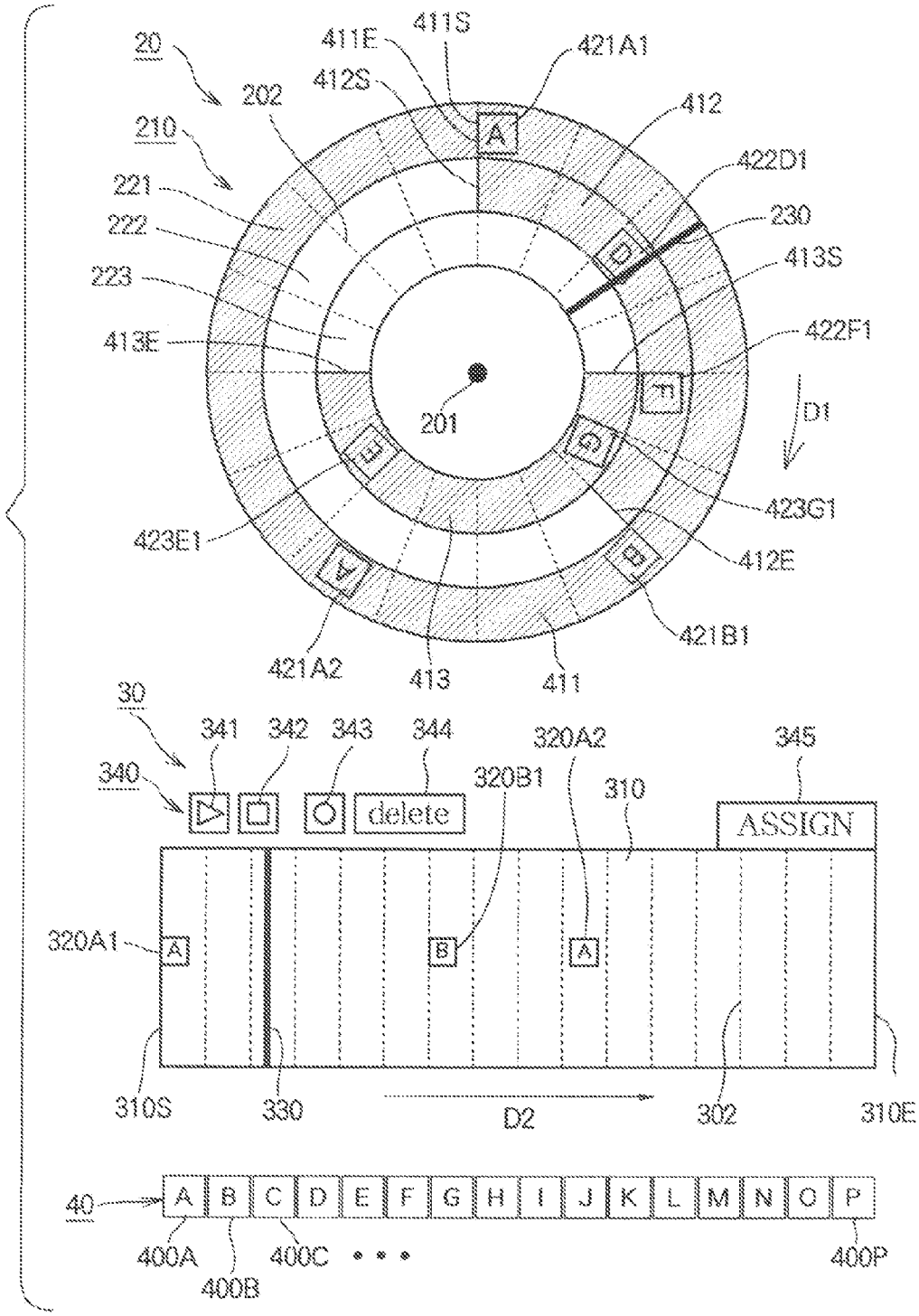
FIG. 3 illustrates exemplary display of the screen provided on the sound generation control apparatus.

FIG. 3 illustrates exemplary display of the screen 141 provided on the sound generation control apparatus 10. A circular sequencer image 20, a rectangular sequencer image 30, and a sound generation data image group 40 are displayed on the screen 141. The sound generation data image group 40 is an image including a plurality of sound generation data images displayed such that the sound generation data images are arranged in a horizontal direction of the screen 141. In this embodiment, the sound generation data image group 40 includes sound generation data images 400A, 400B, 400C, . . . , and 400P which will each be referred to as a "sound generation data image 400" when a specific one is not indicated. The sound generation data images 400A, 400B, 400C, . . . , and 400P correspond to sound generation data A, B, C, . . . , and P, respectively.

The circular sequencer image 20 is one of the sequencer images described above. The circular sequencer image 20 includes a circular image 210 having an outer periphery surrounding a center point 201. Here, the term "circular" indicates a form having an inner periphery and an outer periphery. The circular image 210 includes circular regions 221, 222, and 223 which will each be referred to as a "circular region 220" when a specific one is not indicated. Each circular region 220 includes an inner periphery and an outer periphery surrounding the center point 201. In this embodiment, each of the inner and the outer peripheries of the circular region 220 has a circumferential shape centered on the center point 201.

The circular region 220 is divided into beat regions by beat lines 202 that extend radially from the center point 201. Here, it is assumed that a length of the circular region 220 in a clockwise circumferential direction D1 specifies elapsed time. The beat lines 202 are arranged at regular intervals and represent a meter that is a basic rhythm occurring at regular time intervals. The length of the beat region in the circumferential direction D1 represents the beat length of the beat region. One circumference of the circular region 220 represents beats that are repeated at regular intervals. The number of the beat lines 202 and the number of the beat regions are not limited to the illustrated ones and may be changed according to settings.

Music data images 411, 412, 413, each corresponding to music data representing a piece of music having a specific number of beats, are displayed in a superimposed manner on the circular regions 220. The music data images 411, 412, 413 will each be referred to as a "music data image 410" when a specific one is not indicated. Each of the music data images 410 is displayed such that an elapsed time of corresponding music data corresponds to the length of the corresponding circular region 220 in the circumferential direction D1. For ease of explanation, the music data images 410 are hatched in FIG. 3. The music data images 411, 412, and 413 correspond respectively to music data of 16 beats, music data of 6 beats, and music data of 8 beats. The music data images 411, 412, and 413 have start positions 411S, 412S, and 413S, each representing the start of a corresponding piece of music, respectively. The start positions 411S, 412S, and 413S will each be referred to as a "start position 410S" when a specific one is not indicated. The music data images 411, 412, and 413 also have end positions 411E, 412E, and 413E, each representing the end of a corresponding piece of music, respectively. The end positions 411E, 412E, and 413E will each be referred to as an "end position 410E" when a specific one is not indicated. The start position 411S and the end position 411E are displayed on the same beat line 202, because the music data image 411 is displayed entirely in the corresponding circular or loop region 221.

Sound generation display regions, each indicating both the contents of sounds to be generated in corresponding music data and the timing of generation of the sounds, are arranged in each of the music data images 410. For example, sound generation display regions 421A1, 421B1, and 421A2 are arranged in the music data image 411. The sound generation display regions 421A1, 421B1, and 421A2 will each be referred to as a "sound generation display region 421" when a specific one is not indicated. Images corresponding to sound generation data images 400A, 400B, and 400A are displayed in the sound generation display regions 421A1, 421B1, and 421A2, respectively. Similar to the corresponding sound generation data images 400A, 400B, and 400A, sound generation data A, B, and A correspond respectively to the sound generation display regions 421A1, 421B1, and 421A2. In the music data image 411, a location of each sound generation display region 421 with respect to the start position 411S in the circumferential direction D1 indicates the timing of sound generation of corresponding music data in the music data image 411.

For example, in the music data image 411, the sound generation display regions 421A1, 421B1, and 421A2 are located respectively in the 1st, 7th, and 10th beat regions relative to the start position 411S. In this case, the sound generation display regions 421A1, 421B1, and 421A2 indicate that sounds represented by the sound generation data A, B, and A are generated in the 1st, 7th, and 10th beats relative to the start of the piece of music. The position or location of each of the sound generation display regions 421 in the circumferential direction D1 in the corresponding beat region indicates the timing of generation of the corresponding sound within the beat. For example, the sound generation display region 421A1 is located at a front portion of the 1st beat region in the circumferential direction D1 and thus indicates that the corresponding sound is generated at the start of the 1st beat. The sound generation display region 421A2 is located at the middle of the 10th beat region in the circumferential direction D1 and thus indicates that the corresponding sound is generated at the middle of the 10th beat. The music data image 410 is not limited to an image representing the entire region of the music data, and may merely be an image representing the content of each sound to be generated and the sound generation timing of the sound. For example, the music data image 410 may consist only of a start position 410S, an end position 410E, and sound generation display regions which are fixed in position relative to each other.

A sound generation indication image 230 is a line image which is in contact with both the inner and outer peripheries of the circular image 210 and which has a longitudinal direction directed to the center point 201. When the sound generation indication image 230 is displayed at another position of the circular image 210, the sound generation indication image 230 is also displayed such that the longitudinal direction of the sound generation indication image 230 is directed to the center point 201 depending on the position. The sound generation indication image 230 is an indicator which indicates a position (hereinafter referred to as a "circumferential position") in the circumferential direction D1 of the circular image 210. The sound generation indication image 230 is displayed while the circumferential position thereof is sequentially changed according to the time information output from the time output unit 112. The user perceives the sound generation indication image 230 as moving since the sound generation indication image 230 is displayed while the circumferential position thereof is sequentially changed. The speed at which the sound generation indication image 230 moves is set according to both the tempo of the piece of music, whose sound is generated, and the number of beat regions included in the circular region 220. For example, the sound generation indication image 230 moves at a speed of 120 beat regions per minute when the tempo is set to 120 Beat Per Minute (BPM).

The rectangular sequencer image 30 includes a rectangular image 310 and a manipulation button image group 340. The rectangular image 310 has a rectangular shape elongated in the horizontal direction of the screen 141. The rectangular image 310 corresponds to music data representing a piece of music having a specific number of beats. The rectangular image 310 has a configuration similar to the music data image 410. A start position 310S, an end position 310E, and beat lines 302 in the rectangular image 310 correspond to the start position 410S, the end position 410E, and the beat lines 202 in the music data image 410. The rectangular image 310 has beat regions and sound generation display regions, similar to the music data image 410.

A length of the rectangular image 310 in a longitudinal direction D2 indicates elapsed time. In the example of FIG. 3, the rectangular image 310 corresponds to the same music data as that of the music data image 411. The rectangular image 310 has sound generation display regions 320A1, 320B1, and 320A2 in 1st, 7th, and 10th beat regions, respectively. The number of the beat lines 302 and the number of the beat regions in the rectangular image 310 are not limited to the illustrated ones and may be changed according to manipulation. In addition, the number of the beat regions need not correspond to an integer number of beats and may be, for example, 8.5.

A sound generation indication image 330 is a line image that is in contact with both ends of the rectangular image 310 perpendicular to the longitudinal direction of the beat lines 302 of the rectangular image 310. Thus, the sound generation indication image 330 is displayed such that the longitudinal direction of the sound generation indication image 330 is directed in the longitudinal direction of the beat lines 302. The sound generation indication image 330 indicates a position in the longitudinal direction D2 of the rectangular image 310 which will hereinafter be referred to as a "longitudinal position". The sound generation indication image 330 is displayed while the longitudinal position thereof is sequentially changed according to the time information output from the time output unit 112.

The manipulation button image group 340 includes a playback button image 341, a stop button image 342, a record button image 343, a delete button image 344, and a assign button image 345. When one of these button images is selected according to manipulation (hereinafter simply referred to as "selected"), the display control unit 111, the time output unit 112, and the sound generation control unit 113 perform control operation according to the selected button image. When the playback button image 341 is selected, the time output unit 112 outputs generated time information. The display control unit 111 outputs information required for sound generation control to the sound generation control unit 113 based on the input time information. The sound generation control unit 113 causes the sound generation device 150 to generate sound based on input information. When the stop button image 342 is selected, the time output unit 112 stops outputting the time information. Accordingly, the display control unit 111 stops outputting information to the sound generation control unit 113 and the sound generation control unit 113 stops the sound generation operation. In this manner, the music data begins to be reproduced upon selection of the playback button image 341 and reproduction of the music data is stopped upon selection of the stop button image 342.

When the record button image 343 is selected, the display control unit 111 displays the sound generation indication image 330 based on time information output from the time output unit 112. If the user selects a sound generation data image 400 in this state, the display control unit 111 specifies a position at which the sound generation indication image 330 is displayed upon selection of the sound generation data image 400. The display control unit 111 displays the rectangular image 310 in which a sound generation display region 320 corresponding to the selected sound generation data image 400 is allocated at the specified position. In this manner, the display control unit 111 generates music data whose sound generation timing and sound generation data are represented by the rectangular image 310 in which the sound generation display region 320 is arranged. This state is terminated as the stop button image 342 is selected.

When the delete button image 344 is selected and a sound generation display region 320 is subsequently selected, the display control unit 111 deletes sound generation data of a sound generation timing corresponding to the position of the sound generation display region 320 from the music data. As a result, the sound generation display region 320 is deleted from the rectangular image 310. When the assign button image 345 is selected and a circular loop region 220 is subsequently selected, the display control unit 111 displays music data corresponding to the rectangular image 310 as a music data image 410 on the selected circular loop region 220. As a result, music data corresponding to the rectangular image 310 is assigned to the circular region 220. For example, in FIG. 3, music data corresponding to the rectangular image 310 is assigned to the circular loop region 221.

As described above, the inventive sound generation control apparatus 10 is basically constructed by a display control unit 111, a time output unit 112 and a sound generation control unit 113. The display control unit 111 defines on a display device 140 a loop region 220 having an outer periphery surrounding a reference point 201 and indicating progression of time in association with a length in a circumferential direction D1 of the loop region 220, and displays in the loop region 220 a music data image 410 corresponding to music data which specifies content of music sound to be generated as time progresses, wherein the music data image 410 is displayed in the loop region 220 such that progression of the music data corresponds to the length in the circumferential direction D1 of the loop region 220. The time output unit 112 outputs, upon receiving an instruction to start generation of the music sound, time information indicating a time that progresses from a timing corresponding to the instruction. The sound generation control unit 113 controls the content of the music sound to be generated by a sound generation device 150 based on the music data corresponding to the music data image 410 and according to a relationship between a position in the circumferential direction D1 of the loop region 220 determined by the time information (230) outputted by the time output unit 112 and a location of the music data image 410 in the loop region 220. Characterizingly, the display control unit 111 performs control operation for displaying a plurality of music data images 411, 412 and 413 in the loop region 410 on the display device 140, and the sound generation control unit 113 performs control operation for simultaneously generating a plurality of music sounds corresponding to the plurality of the music data images 411, 412 and 413 as the time progresses.

Expediently, the display control unit 111 defines a plurality of loop regions 221, 222 and 223, and displays a plurality of the music data images 411, 412 and 413 in at least two of the plurality of the loop regions 221, 222 and 223. Specifically, the display control unit 111 defines the plurality of the loop regions 221, 222 and 223 arranged concentric with each other around the reference point 201 common to the plurality of the loop regions 221, 222 and 223.

Expediently, the display control unit 111 displays an indicator 230 which indicates the position in the circumferential direction D1 of the loop region 220 determined by the time information, such that the indicator 230 travels in the circumferential direction D1 of the loop region 220 as the time progresses, and the sound generation control unit 113 performs the control operation for generating the plurality of the music sounds in looping manner as the indicator 230 travels cyclically through the loop region 220.

The above is a description of the components for implementing the sound generation control function. The following is a description of examples of content displayed on the screen 141 under control of the display control unit 111 described above.

[Exemplary Display in Sound Generation Control Function]

Figure 4:
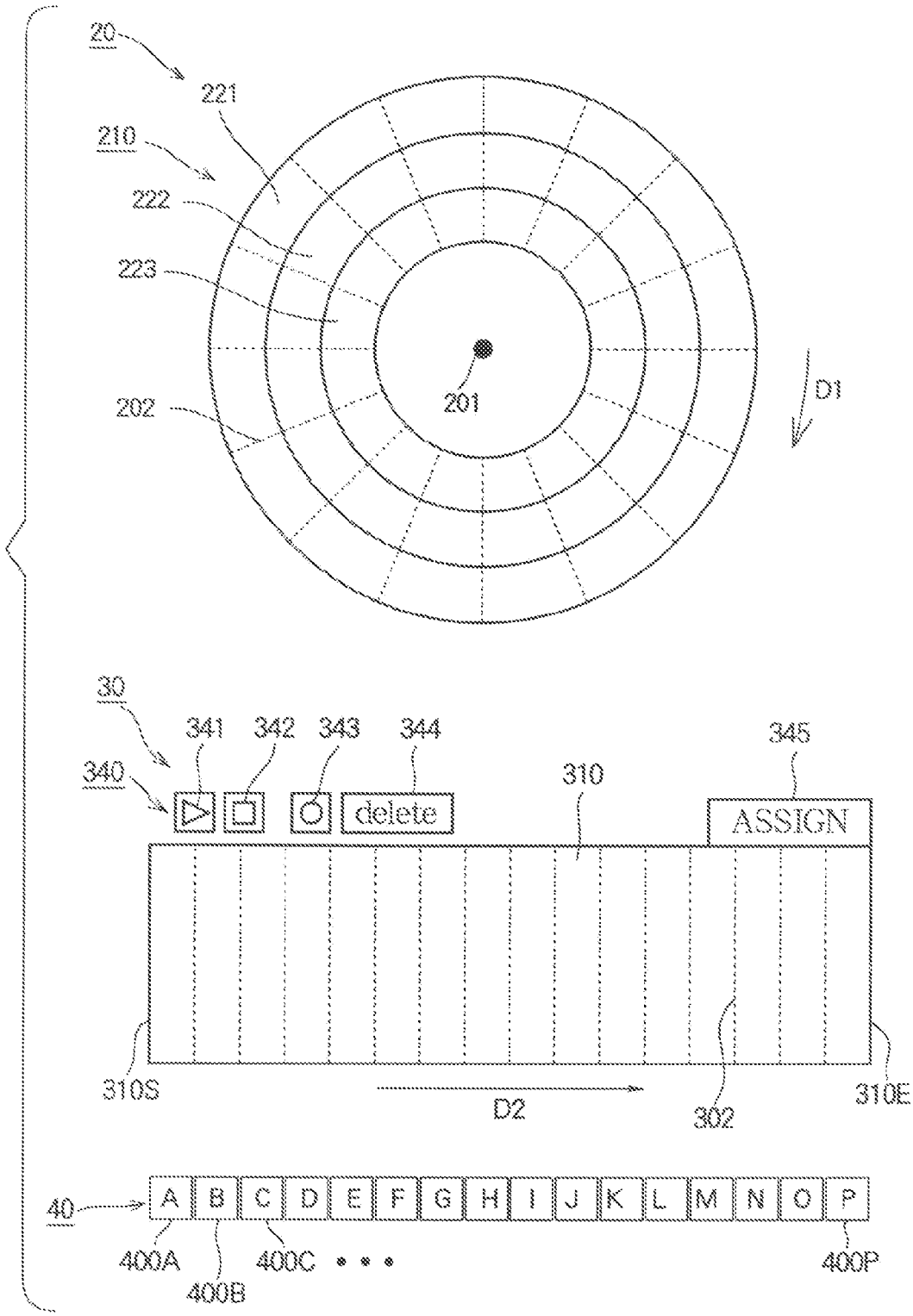
FIG. 4 illustrates first exemplary display of the screen in the sound generation control function.

FIGS. 4, 5, 6, and 7 illustrate first, second, third, and fourth exemplary display of the screen 141 in the sound generation control function. First, when the sound generation control function starts, the display control unit 111 displays content shown in FIG. 4 on the screen 141. Specifically, the display control unit 111 displays a circular sequencer image 20, a rectangular sequencer image 30, and a sound generation data image group 40 on the screen 141. The display control unit 111 displays circular regions 220, beat lines 202, beat lines 302, and sound generation data images 400 on the screen 141. In the example of FIG. 4, the display control unit 111 displays 3 circular regions 220, 16 beat lines 202, 15 beat lines 302, and 16 sound generation data images 400. When settings of the numbers of these images are changed, the display control unit 111 displays the changed numbers of the images.

Figure 5:
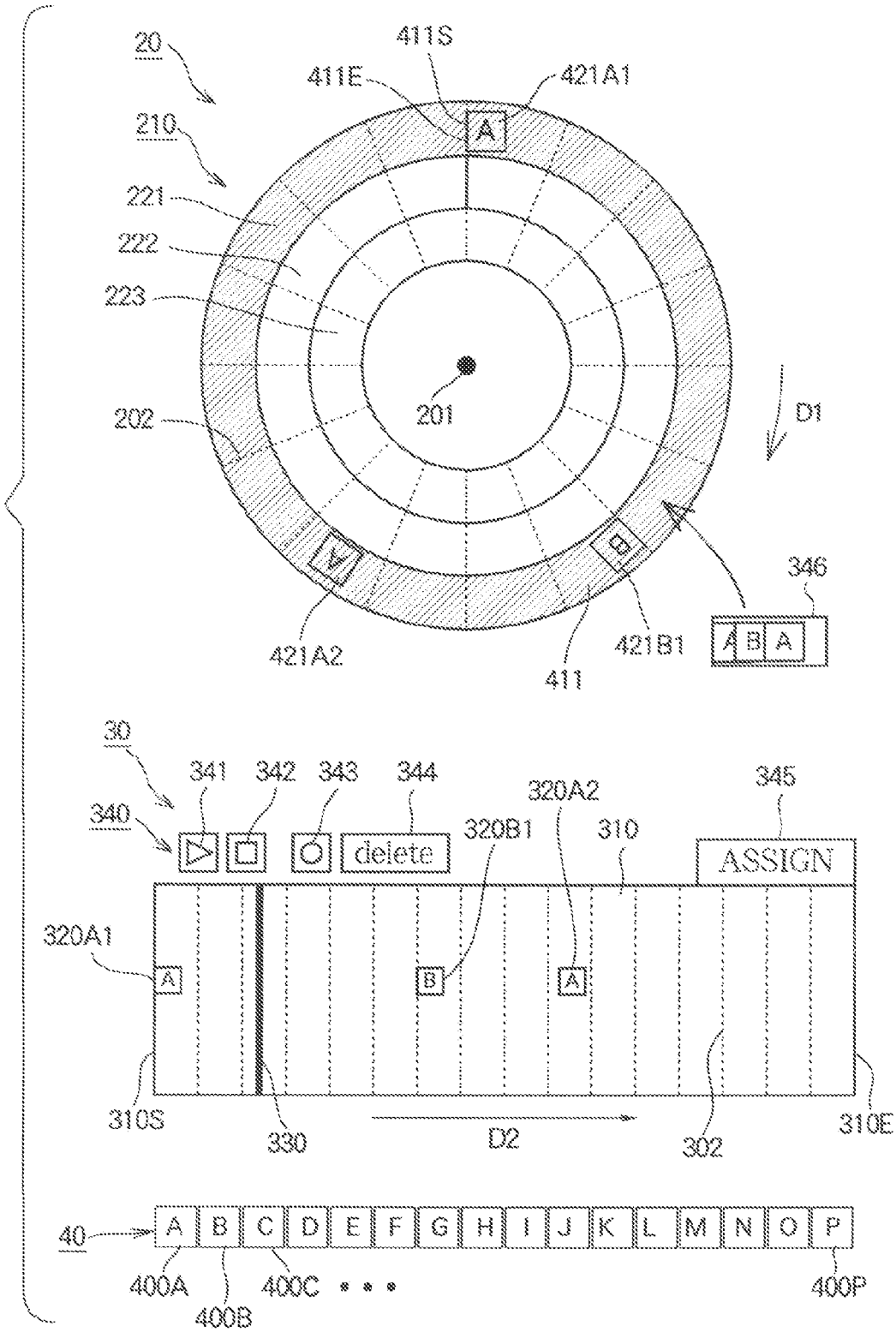
FIG. 5 illustrates second exemplary display of the screen in the sound generation control function.

When one music data image is assigned to a circular region in the display state of FIG. 4, the display state is switched to a display state of FIG. 5. The user selects one of the sound generation data images 400 through manipulation and then specifies a specific position on the rectangular image 310. The display control unit 111 displays the rectangular image 310 in which a sound generation display region 320 corresponding to the selected sound generation data image 400 is arranged at the specified position. In the example of FIG. 5, the display control unit 111 displays a rectangular image 310 including sound generation display regions 320 corresponding to sound generation data images 400A and 400B. In this state, the user selects the playback button image 341 through manipulation. This allows the display control unit 111, the time output unit 112, and the sound generation control unit 113 to reproduce music data corresponding to the rectangular image 310. The user edits the music data by adding or deleting a sound generation display region 320 or changing the position of a sound generation display region 320 while listening to the reproduced sound of the music data.

After composing and editing the music data, the user selects the assign button image 345 through manipulation. The display control unit 111 displays a music data image 346 representing music data corresponding to the rectangular image 310 on the screen 141. If the user selects the circular region 221 through manipulation in this state, the display control unit 111 displays a music data image 411 corresponding to the music data in the circular region 221. Here, the user may freely select the position of the start position 411S through manipulation. In the example of FIG. 5, the start position 411S is located at an upper portion of a beat line 202 that extends in a vertical direction of the screen 141.

Figure 6:
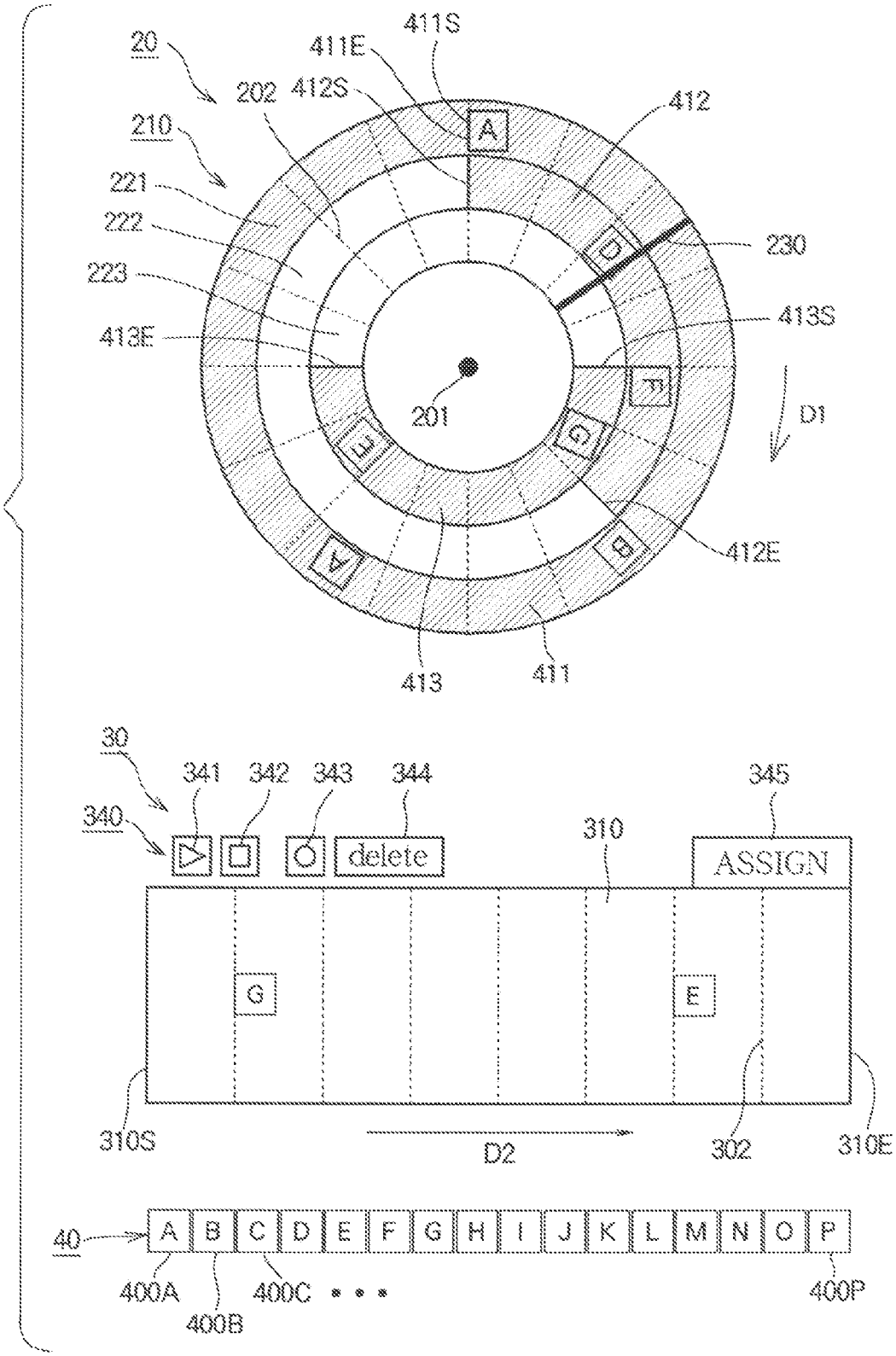
FIG. 6 illustrates third exemplary display of the screen in the sound generation control function.

When two music data images are additionally assigned to the display state of FIG. 5, the display state is switched to a display state of FIG. 6. The display control unit 111 displays a music data image 412 corresponding to music data of 6 beats in the circular region 222 and displays a music data image 413 corresponding to music data of 8 beats in the circular region 223. When the user instructs reproduction of music through manipulation, the display control unit 111 displays a sound generation indication image 230 at a position in the circumferential direction D1 in the circular regions 220, the position being determined from a specific position in the circular region 220 according to time information output from the time output unit 112. This specific position is, for example, a position at which the sound generation indication image 230 is displayed last or a position that is predetermined through setting. The sound generation control unit 113 performs sound generation through the sound generation device 150 based on both a relationship between a position at which the sound generation indication image 230 is currently displayed and the location of the music data image 410 in the circular region and music data corresponding to the music data image 410.

Figure 7:
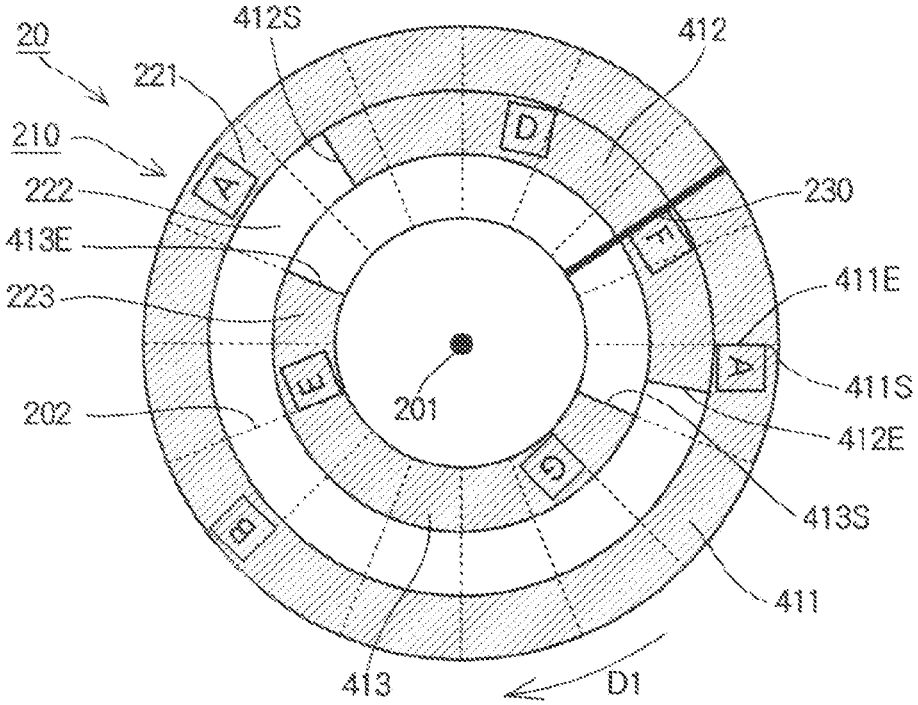
FIG. 7 illustrates fourth exemplary display of the screen in the sound generation control function.

When the locations of the music data images are changed in the display state of FIG. 6, the display state is switched to a display state of FIG. 7. The display control unit 111 displays the music data images 410 in the circular regions 220, respectively. In this state, the user manipulates the manipulation device 130 so as to move a music data image 410 in the circumferential direction D1. According to this manipulation, the display control unit 111 displays the music data image 410 at the position to which the music data image 410 has moved along the circumferential direction D1. In the example of FIG. 7, the display control unit 111 displays the music data image 411 at a position to which the music data image 411 has moved by 4 beat regions from the position shown in FIG. 6 along the circumferential direction D1. The display control unit 111 also displays the music data image 412 at a position to which the music data image 412 has moved by 14.5 beat regions from the position shown in FIG. 6 along the circumferential direction D1, and the music data image 413 at a position to which the music data image 413 has moved by one beat region from the position shown in FIG. 6 along the circumferential direction D1. The display control unit 111 operates in this manner to control display of a plurality of music data images so as to move each of the plurality of music data images along the circumferential direction D1 according to an instruction received from the outside and to change a positional relationship between the music data images accordingly. Namely, the display control unit 111 performs control operation for moving one or more of the plurality of the music data images 411, 412 and 413 in the circumferential direction D1 of the loop region 220 according to an instruction so as to change relative locations among the plurality of the music data images 411, 412 and 413 in the loop region 220.

Through the above operations of the components of the sound generation control apparatus 10, the user can edit each of a plurality of music data while changing reproduction timings of the plurality of music data. Here, it is also easy for the user to visually perceive the intervals between sound generation timings of sound generation data images 400 arranged in different circular regions 220 based on respective radial directions of the sound generation data images 400 with respect to the center point 201. Therefore, the user can compose loop music while appropriately adjusting the intervals among sound generation timings of a plurality of music data even when repeatedly performing sound generation of the plurality of music data while changing the sound generation timings of the plurality of music data.

Although the embodiment of the invention has been described above, the invention may also be implemented in other forms.

<Modification 1>

Although the display control unit 111 displays one music data image 410 in one circular region 220 in the above embodiment, the invention is not limited to this example and a plurality of music data images 410 may be displayed on one circular region 220. In this case, to allow the user to easily identify regions in which the music data images 410 are displayed, the display control unit 111 may display the music data images 410 and overlapping regions of the music data images 410 in different manners such as different colors or different hatchings.

Figure 8:
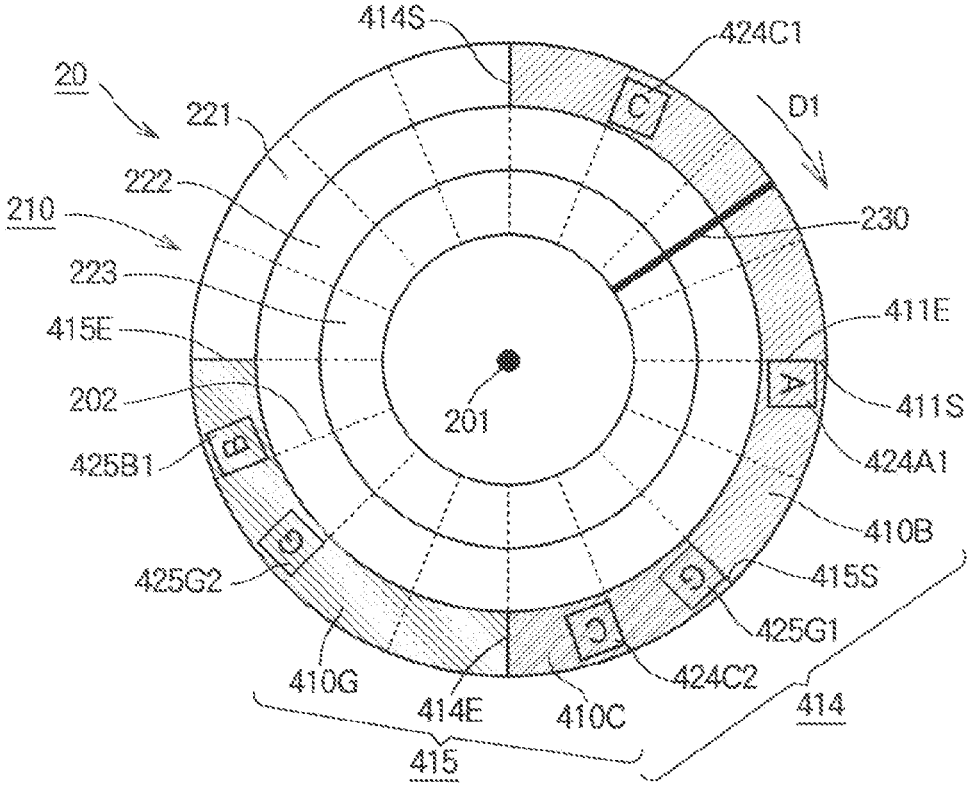
FIG. 8 illustrates a circular sequencer image according to Modification 1.

FIG. 8 illustrates a circular sequencer image 20 according to Modification 1. The display control unit 111 displays a music data image 414 representing a piece of music of 8 beats and a music data image 415 representing a piece of music of 6 beats in a circular region 221. The music data image 414 includes a start position 414S, an end position 414E, and sound generation display regions 424C1, 424A1, and 424C2. The music data image 415 includes a start position 415S, an end position 415E, and sound generation display regions 425G1, 425G2, and 425B1. In the example of FIG. 8, the display control unit 111 displays the music data image 414 and the music data image 415 such that 7th and 8th beat regions of the music data image 414 and 1st and 2nd beat regions of the music data image 415 overlap. The 1st to 6th beat regions of the music data image 414, the 3rd to 6th beat regions of the music data image 415, and the beat regions in which the two music data images 414 and 415 overlap are displayed as an image 410B, an image 410G, and an image 410C, respectively, which are indicated by different hatchings. In this case, the display control unit 111 may display the image 410B in blue, the image 410G in green, and the image 410C in cyan. These colors may be freely changed according to the settings. As described above, the display control unit 111 defines a loop region 221 common to the plurality of the music data images 414 and 415, and displays the plurality of the music data images 414 and 415 in the common loop region 221 by different manners such that the plurality of the music data images 414 and 415 are visually discriminated from each other <Modification 2>

Although the display control unit 111 displays the 3 circular regions 221, 222, and 223 in the above embodiment, the display control unit 111 may also display a different number of circular regions 220 according to the settings. The user may edit the music by changing the performance timings of the same number of music data images 410 as the number of the circular regions 220 while simultaneously performing sound generation of the music data images 410. The display control unit 111 may also change the settings to display a different number of circular regions 220 after displaying a specific number of circular regions 220.

<Modification 3>

Although the display control unit 111 displays the circular regions 220, each of which is divided into the same number of beat regions in the above embodiment, the display control unit 111 may also display circular regions 220 which are divided into different numbers of beat regions. For example, the display control unit 111 may display a circular region 221 which is divided into 16 beat regions, a circular region 222 which is divided into 8 beat regions, and a circular region 223 which is divided into 24 beat regions. In this case, the display control unit 111 may display a sound generation indication image 230 so as to match the setting of the tempo of one of the circular regions 221, 222, and 223.

Figure 9:
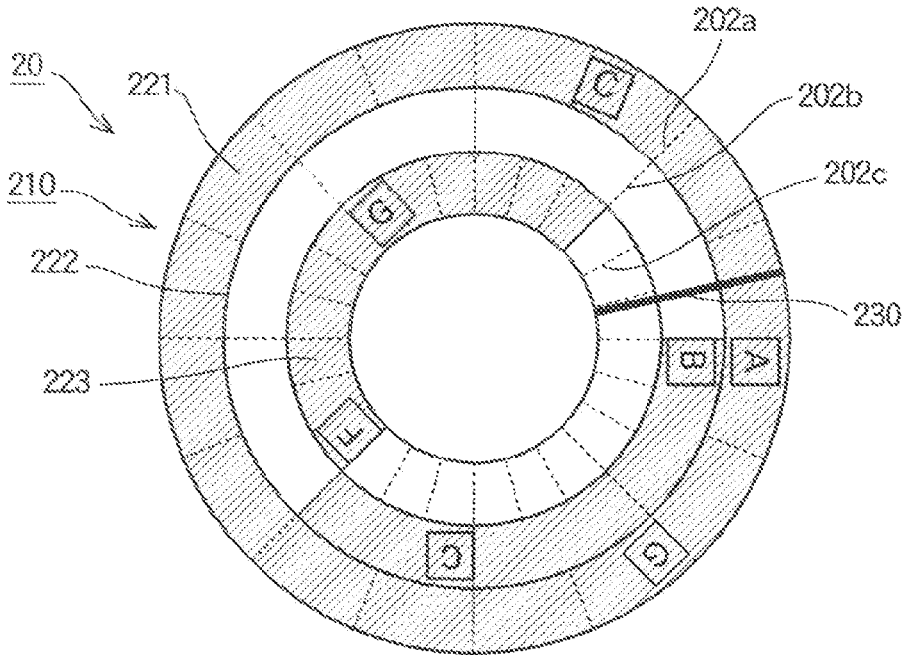
FIG. 9 illustrates a circular sequencer image according to Modification 3.

FIG. 9 illustrates a circular sequencer image 20 according to Modification 3. The display control unit 111 displays circular regions 221, 222, and 223 which are divided into 16 beat regions, 8 beat regions, and 24 beat regions by beat lines 202*a*, beat lines 202*b*, and beat lines 202*c*, respectively. The number of beat regions into which each circular region 220 is divided may be freely changed according to the settings. For example, the number of beat regions of each circular region 220 may also be set according to the number of beats of corresponding music data composed on the rectangular sequencer image 30 when the music data is assigned. The number of beat regions of each circular region 220 may also be individually set for each circular region 220 selected through manipulation.

<Modification 4>

Although the display control unit 111 displays the circular regions 220 having the same widths in the radial direction from the center point 201 in the above embodiment, the display control unit 111 may also display circular regions 220 having different radial widths. The radial widths of the circular regions 220 may be freely changed according to the settings. The radial widths may be fixed according to the settings and may also be changed in real time. The sound generation control unit 113 may perform sound generation of each circular region 220 while changing the feature of generated sound according to the width of the circular region 220. For example, the sound generation control unit 113 may perform sound generation of each circular region 220 such that the volume of generated sound of sound generation data corresponding to a sound generation data image 400 displayed in the circular region 220 increases as the radial width of the circular region 220 increases. The display control unit 111 may also display each circular region 220 while changing the radial width of each circular region 220 in real time according to the feature of assigned music data. For example, the display control unit 111 may display each circular region 220 such that the radial width of the circular region 220 increases as the number of sound generation data images 400 arranged in the circular region 220 increases.

Figure 10:
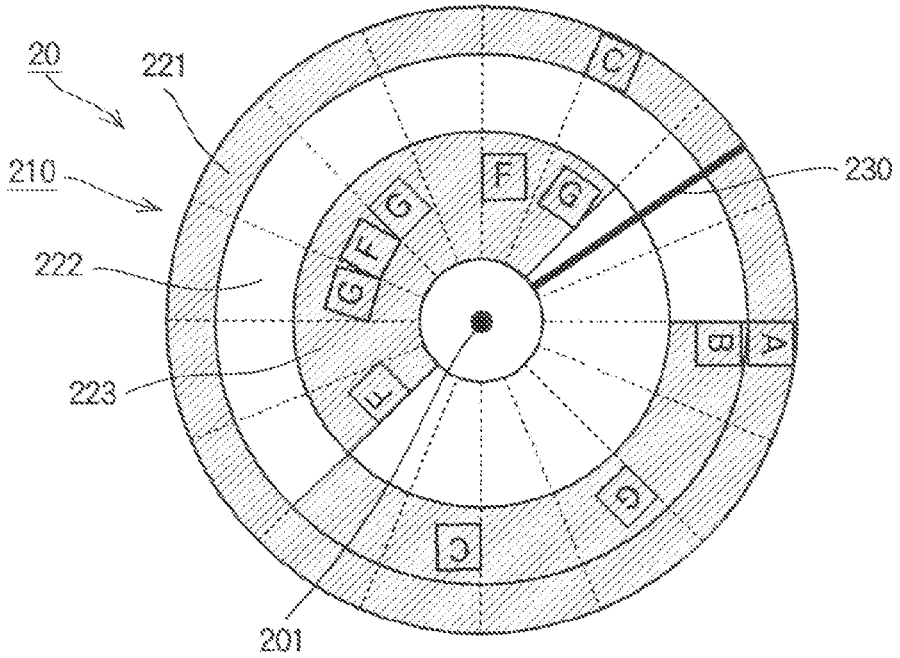
FIG. 10 illustrates a circular sequencer image according to Modification 4.

FIG. 10 illustrates a circular sequencer image 20 according to Modification 4. In the example of FIG. 10, the display control unit 111 displays 2, 3, and 6 sound generation data images 400 in circular regions 221, 222, and 223, respectively. The display control unit 111 displays each of the circular regions 221, 222, and 223 such that the width of the circular region increases as the number of sound generation data images 400 in the circular region increases.

[Modification 5]

Although the display control unit 111 displays the inner and outer peripheries of each circular region 220 in circular shapes in the above embodiment, the invention is not limited to the circular peripheries and the inner and outer peripheries of each circular region 220 may be displayed in other shapes. For example, the display control unit 111 may display the inner and outer peripheries of each ringed or annular region 220 in elliptical or rectangular shapes. In this case, the outer peripheries of the loop regions are in similar shapes. The display control unit 111 preferably displays the reference point 201 at the center of each loop region 220. The display control unit 111 may display a loop region 220 closest to the center point 201 as a region having no inner periphery. Also in this case, the loop region 220 may have an outer periphery surrounding the center point 201.

Figure 11:
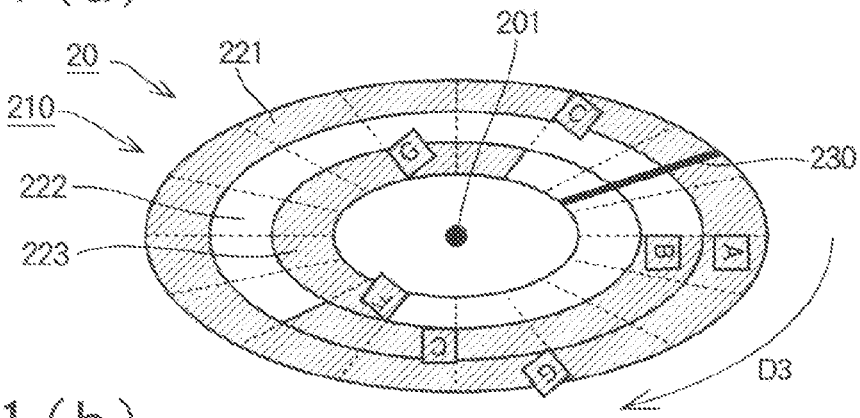
FIGS. 11(*a*) to 11(*c*) illustrate a ringed sequencer image according to Modification 5.
Figure 11:
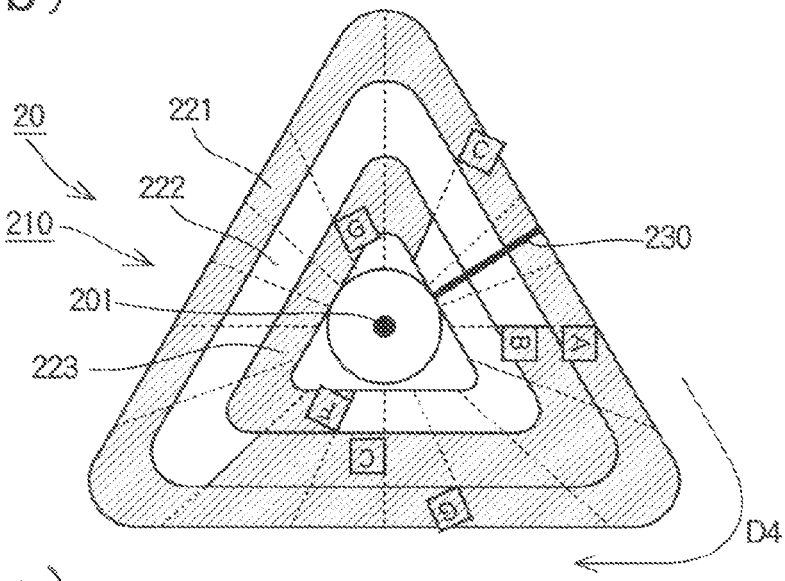
Figure 11:
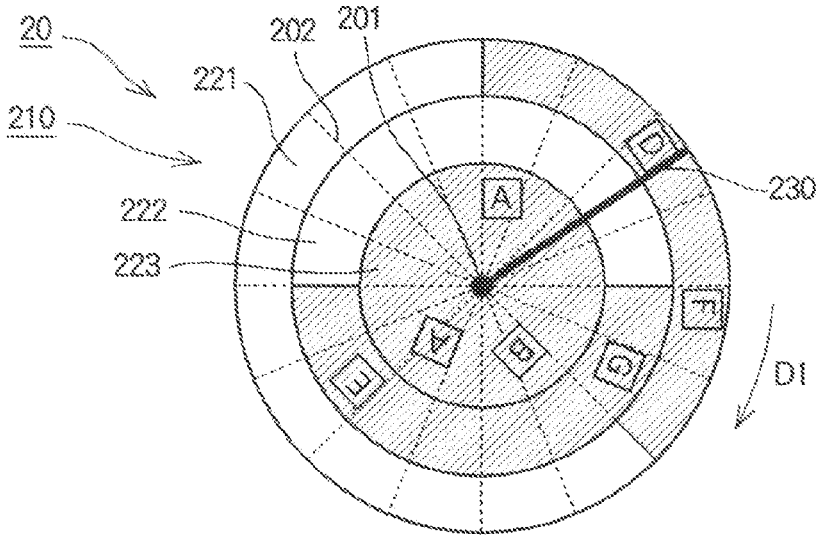

FIGS. 11(*a*) to 11(*c*) illustrate sequencer images 20 according to Modification 5. FIG. 11(*a*) illustrates a sequencer image 20 including loop regions 220 having elliptical inner and outer peripheries. FIG. 11(*b*) illustrates a sequencer image 20 including loop regions 220 having inner and outer peripheries that are triangular with rounded corners. FIG. 11(*c*) illustrates a sequencer image 20 including circular regions 220, among which a circular region 220 closest to the center point 201 has no inner periphery. In all FIGS. 11(*a*) to 11(*c*), the display control unit 111 displays the concentrical loop regions 220 having similar shapes. In FIGS. 11(*a*) and 11(*b*), the display control unit 111 displays beat regions having shapes that vary depending on positions thereof in circumferential directions D3 and D4. Namely, the display control unit 111 defines a loop region 220 having an annular shape geometrically symmetric with respect to the reference point 201.

<Modification 6>

Although sound generation data is waveform data representing a waveform signal of a musical sound having a predetermined time length in the above embodiment, the sound generation data may also be feature quantity data, which is a numerical value indicating the quantity of feature of sound, or control data of sound such as Musical Instrument Digital Interface (MIDI) data. In this case, the sound generation control unit 113 performs sound generation of the sound control data or feature quantity data through the sound generation device 150 after converting the sound control data or feature quantity data into sound waveform data. The sound generation control unit 113 may also perform sound generation of the feature quantity data through the sound generation device 150 after controlling an external device connected through the interface 160 to convert the feature quantity data into waveform data.

<Modification 7>

In the above embodiment, the display control unit 111 displays the circular regions 220 and the music data images 410 at fixed positions and in fixed directions and displays the sound generation indication image 230 while sequentially changing the position and direction of the sound generation indication image 230. However, the invention is not limited to this mode, and the display control unit 111 may display the sound generation indication image 230 at a fixed position and in a fixed direction and display the circular regions 220 and the music data images 410 while sequentially changing the positions and directions of the circular regions 220 and the music data images 410 as the time progresses. In this case, the display control unit 111 displays the circular regions 220 and the music data images 410 while sequentially changing the directions of the circular regions 220 and the music data images 410 along the circumferential direction D1. In all these cases, positional relationships between the sound generation indication images 230 and the music data images 410 are sequentially changed along the circumferential direction D1 as time elapses.

<Modification 8>

Although the display control unit 111 displays the circular sequencer image 20 and the rectangular sequencer image 30 in different regions of the screen 141 in the above embodiment, the display control unit 111 may also display the circular sequencer image 20 and the rectangular sequencer image 30 in the same region. For example, the display control unit 111 may switch between display of the circular sequencer image 20 and display of the rectangular sequencer image 30 through manipulation. The display control unit 111 may also display the circular sequencer image 20 and the rectangular sequencer image 30 in an overlapping manner. In this case, the display control unit 111 may display one of the sequencer images 20 and 30 that has been manipulated in a dark color and display the other that has not been manipulated in a light color in an overlapping manner. Displaying two sequencer images in this manner allows the user to easily identify which sequencer image is manipulated.

<Modification 9>

In the above embodiment, the display control unit 111 displays a music data image 410 on the circular sequencer image 20 by assigning corresponding music data composed and edited on the rectangular sequencer image 30. However, the invention is not limited to this mode, and the display control unit 111 may also display a music data image 410 composed and edited on the circular sequencer image 20. In this case, upon selection of the manipulation button image group 340, the display control unit 111, the time output unit 112, and the sound generation control unit 113 may operate to perform reproduction of music, stop reproduction, and perform recording of the circular sequencer image 20. The user may edit music data while composing the music data by selecting the record button image 343 and reproducing the music data by selecting the playback button image 341.

<Modification 10>

Although the display control unit 111 displays only one sound generation indication image 230 for the entire circular image 210 in the above embodiment, the display control unit 111 may also display individual sound generation indication images for the respective circular regions 220. The display control unit 111 and the time output unit 112 may display the sound generation indication images at different speeds and in different directions. In this case, the display control unit 111 displays the sound generation indication images based on the settings of the movement direction and tempo of each circular region 220 and the time information input to the display control unit 111.

Figure 12:
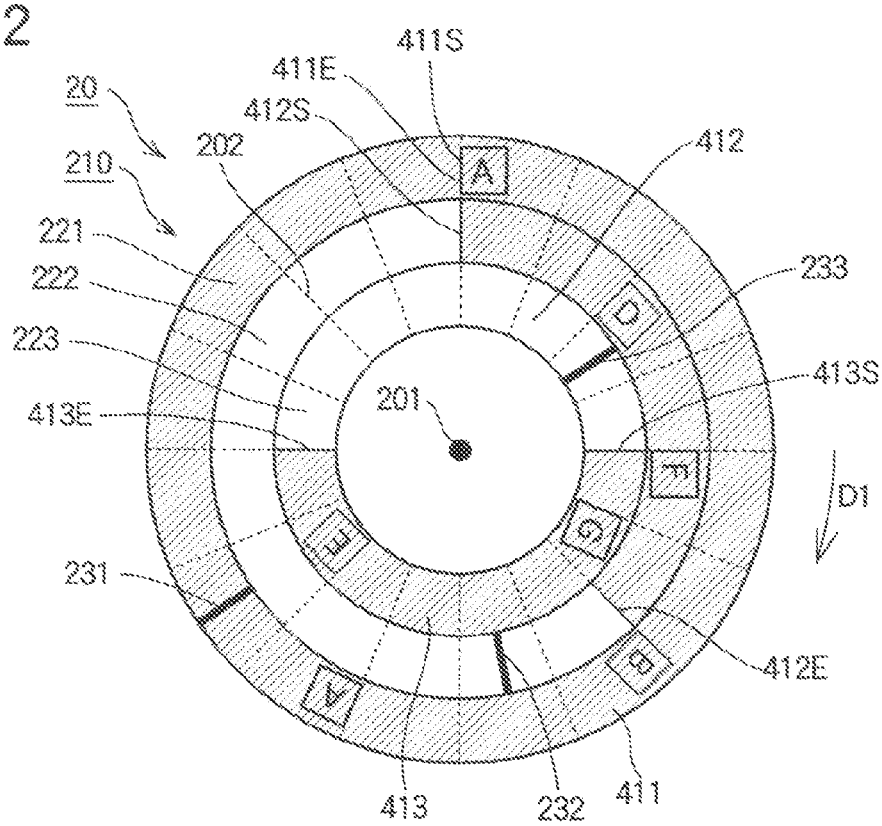
FIG. 12 illustrates a circular sequencer image according to Modification 10.

FIG. 12 illustrates a circular sequencer image 20 according to Modification 10. The display control unit 111 displays sound generation indication images 231, 232, and 233 on circular regions 221, 222, and 223, respectively. For example, the display control unit 111 may display the sound generation indication images 231, 232, and 233 such that the sound generation indication image 232 rotates twice and the sound generation indication image 233 rotates three times while the sound generation indication image 231 rotates once. In this case, positional relationships between the sound generation indication images 231, 232, and 233 are changed as time elapses.

<Modification 11>

The display control unit 111 outputs information regarding the position in the radial direction from the center point 201 (hereinafter referred to as a "radial position") of a sound generation display region arranged in a music data image to the sound generation control unit 113. The sound generation control unit 113 may perform sound generation while changing details of the sound depending on the received position information. For example, the sound generation control unit 113 may generate a smaller volume of sound for a sound generation display region as the radial position of the sound generation display region is closer to the center point 201 and generate a larger volume of sound for the sound generation display region as the radial position is farther from the center point 201. The invention is not limited to this example, and the sound generation control unit 113 may also generate sound for each sound generation display region while changing the pitch, tone color, sound generation duration, or the like of the sound depending on the radial position of the sound generation display region.

<Modification 12>

When the sound generation indication image 230 is displayed within a specific zone in the circumferential direction D1 within the circular image 210, the specific zone being specified through manipulation, the display control unit 111 outputs a signal indicating this state to the sound generation control unit 113. The sound generation control unit 113 may generate a changed sound upon receiving the signal. For example, upon receiving the signal, the sound generation control unit 113 may generate a reduced volume of sound (or a muted sound), a sound to which an effect has been imparted, or a sound whose pitch has been changed. This allows the user to easily visually identify a beat or measure at which sound is changed among the beats of music data when sounds of a plurality of pieces of music are simultaneously generated. The same is true when a plurality of sound generation indication images are displayed as described above in Modification 10.

Figure 13:
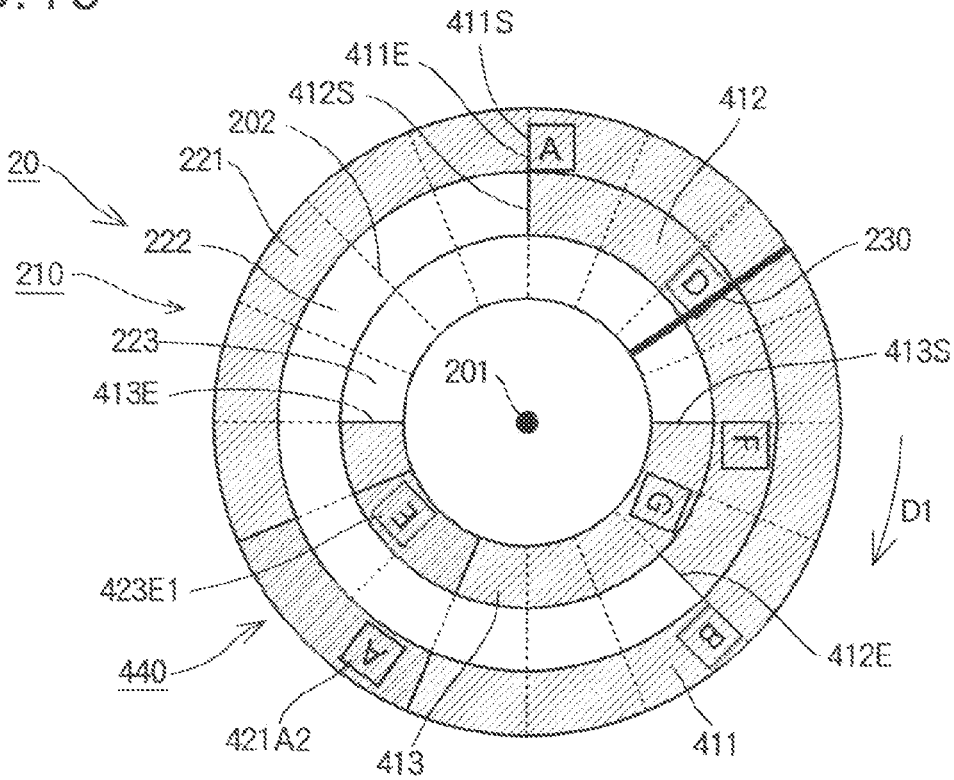
FIG. 13 illustrates a circular sequencer image according to Modification 12.

FIG. 13 illustrates a circular sequencer image 20 according to Modification 12. The display control unit 111 displays the same music data images 410 as shown in FIG. 3. For example, the user specifies a region 440 between 9th and 11th beat lines 202, counted from a start position 411S, in circular regions 221, 222, and 223 through manipulation of the manipulation device 130. The manipulation device 130 outputs information regarding the position of the specified zone 440 to the display control unit 111. The display control unit 111 displays the specified zone 440 in a color different from that of the circular regions 220 and music data images 410. The display control unit 111 may also display the specified zone 440 in a different design, shape, brightness, or the like, provided that the specified zone 440 can be easily identified by the user. In FIG. 13, music data images 410 in the specified zone 440 are shown by a different hatching from other ranges for ease of explanation.

In the example of FIG. 13, a sound generation display region 421A2 of the music data image 411 and a sound generation display region 423E1 of the music data image 413 are displayed in the specified zone 440. In this case, the sound generation control unit 113 generates sounds corresponding to the sound generation display regions 421A2 and 423E1, for example, in a small volume. The specified zone is not limited to a zone of beat regions and the display control unit 111 may also display a zone including only a part of a beat region as a specified zone. The display control unit 111 may also display a plurality of specified ranges and may also display a specified zone 440 while changing the position or area of the specified zone 440 according to manipulation. Namely, the display control unit 111 includes a zone specification unit that specifies a zone 440 in the circumferential direction D1 of the loop region 220. The sound generation control unit 113 changes the content of the music sound to be generated by the sound generation device 150 when the position determined according to the time information is within the zone 440 specified by the zone specification unit.

<Modification 13>

Although the sound generation control unit 113 performs sound generation based on music data which specifies the content of sound to be generated and the sound generation timing of the sound in the above embodiment, the sound generation control unit 113 may also perform sound generation based on music data including data representing an entire continuous waveform. In this case, each music data image 410 preferably has a design, color shadings, a picture, or the like representing a waveform corresponding to music data to allow the user to easily identify the content of the music data. Also in this case, the display control unit 111 outputs information required for sound generation control to the sound generation control unit 113 based on a position at which a sound generation indication image 230 is displayed and locations at which the music data images 410 are displayed. The sound generation control unit 113 performs sound generation through the sound generation device 150 based on the content of sound that has been instructed to be generated.

<Modification 14>

Although the sound generation indication image 230 is a line image in the above embodiment, the sound generation indication image 230 is not limited to the line image and the sound generation indication image 230 may be any image, provided that the image indicates the circumferential position as a visual indicator. For example, the sound generation indicator may be a figure such as an ellipse or triangle, a line segment shorter than the radial width of the circular regions 220, a dashed line, a pattern, or the like. The display control unit 111 may also display the sound generation indication image 230 in a region other than the circular image 210. For example, the display control unit 111 may display a line image extending from the center point 201 to the outer periphery of the circular image 210 as the sound generation indication image 230. In this case, the user views that the linear sound generation indication image 230, which extends in the radial direction from the circular image 210, rotates about the center point 201.

<Modification 15>

Although the display control unit 111 displays the sound generation indication image 230 according to user manipulation in the above embodiment, the display control unit 111 may also automatically display the sound generation indication image 230 at the same time as when a music data image 410 is displayed. The display control unit 111 may also automatically display the sound generation indication image 230 at the same time as when the circular image 210 is displayed. The display control unit 111 may also display the sound generation indication image 230 while moving the sound generation indication image 230 in a direction or at a speed set through user manipulation. For example, the user touches a touch sensor with their finger to select the sound generation indication image 230 and then moves the finger in a direction and speed in which they desire to rotate the sound generation indication image 230. The manipulation device 130 outputs information of the direction and speed to the display control unit 111. The display control unit 111 displays the sound generation indication image 230 while moving the sound generation indication image 230 according to the information.

<Modification 16>

The display control unit 111 may perform a quantization process when arranging a sound generation display region 320. For example, when a position in the rectangular image 310 is specified through user manipulation, the display control unit 111 arranges the sound generation display region 320 at a front side, in the longitudinal direction D2, of a beat region including the specified position. In this case, the display control unit 111 outputs music data that allows a sound corresponding to the sound generation display region 320 to be generated at the start of a beat indicated by the beat region. The invention is not limited to this and the display control unit 111 may also output music data that allows the sound to be generated at a specific timing within the beat indicated by the beat region. As a result, in this case, the display control unit 111 displays the sound generation display region 320 such that the sound generation display region 320 is arranged at a position in the beat region corresponding to the specific timing. This specific timing is, for example, the start, middle, or end of the beat, or a timing at which the beat is equally divided. By operating in this manner, the display control unit 111 allows the user to easily arrange the sound generation display region 320 at a position indicating the specific timing in the music data image.

The display control unit 111 may display the sound generation display region 320 such that the sound generation display region 320 moves from a position specified through manipulation to a to-be-displayed position until the sound generation display region 320 reaches the to-be-displayed position after the position is specified through manipulation. By operating in this manner, the display control unit 111 allows the user to easily identify the displayed position of the sound generation display region 320 even when the displayed position is different from the specified position.

The sound generation control program in the above embodiment may be provided in a state stored in a machine readable storage medium such as a magnetic recording medium (for example, a magnetic tape or a magnetic disk), an optical recording medium (for example, an optical disc), a magneto-optical recording medium, or a semiconductor memory. The sound generation control apparatus 10 may also download the sound generation control program over a network.

What is claimed is:

1. A sound generation control apparatus comprising:

a display control unit that defines on a display device a loop region having an outer periphery surrounding a reference point and indicating progression of time in accordance with time information and in association with a length in a circumferential direction of the loop region, and that displays in the loop region a music data image corresponding to music data which specifies content of music sound to be generated as time progresses, wherein the music data image is displayed in the loop region such that progression of the music data corresponds to the length in the circumferential direction of the loop region;

a time output unit that outputs, upon receiving an instruction to start generation of the music sound, the time information indicating a time that progresses from a timing corresponding to the instruction; and a sound generation control unit that controls the content of the music sound to be generated by a sound generation device based on the music data corresponding to the music data image and according to a relationship between a position in the circumferential direction of the loop region determined by the time information outputted by the time output unit and a location of the music data image in the loop region, wherein the display control unit performs control operation for displaying a plurality of music data images in the loop region on the display device, and the sound generation control unit performs control operation for simultaneously generating a plurality of music sounds corresponding to the plurality of the music data images as the time progresses.

2. The sound generation control apparatus according to claim 1, wherein the display control unit performs control operation for moving one or more of the plurality of the music data images in the circumferential direction of the loop region according to an instruction so as to change relative locations among the plurality of the music data images in the loop region.

3. The sound generation control apparatus according to claim 1, wherein the display control unit includes a zone specification unit that specifies a zone in the circumferential direction of the loop region, wherein the sound generation control unit changes the content of the music sound to be generated by the sound generation device when the position determined according to the time information is within the zone specified by the zone specification unit.

4. The sound generation control apparatus according to claim 1, wherein the display control unit defines a plurality of loop regions, and displays a plurality of the music data images in at least two of the plurality of the loop regions.

5. The sound generation control apparatus according to claim 4, wherein the display control unit defines the plurality of the loop regions arranged concentric with each other around the reference point common to the plurality of the loop regions.

6. The sound generation control apparatus according to claim 1, wherein the display control unit defines a loop region common to the plurality of the music data images, and displays the plurality of the music data images in the common loop region by different manners such that the plurality of the music data images are visually discriminated from each other.

7. The sound generation control apparatus according to claim 1, wherein the display control unit defines a loop region having an annular shape geometrically symmetric with respect to the reference point.

8. The sound generation control apparatus according to claim 1, wherein the display control unit displays an indicator which indicates the position in the circumferential direction of the loop region determined by the time information, such that the indicator travels in the circumferential direction of the loop region as the time progresses, and wherein the sound generation control unit performs the control operation for generating the plurality of the music sounds in looping manner as the indicator travels cyclically through the loop region.

9. A method of controlling generation of music sounds with aide of a display device, the method comprising the steps of:

defining on the display device a loop region having an outer periphery surrounding a reference point and indicating progression of time in accordance with time information and in association with a length in a circumferential direction of the loop region;

displaying in the loop region a music data image corresponding to music data which specifies content of music sound to be generated as time progresses, wherein the music data image is displayed in the loop region such that progression of the music data corresponds to the length in the circumferential direction of the loop region;

outputting, upon receiving an instruction to start generation of the music sound, the time information indicating a time that progresses from a timing corresponding to the instruction; and generating the music sound based on the music data corresponding to the music data image and according to a relationship between a position in the circumferential direction of the loop region determined by the time information and a location of the music data image in the loop region, wherein the step of displaying displays a plurality of music data images in the loop region, and the step of generating simultaneously generates a plurality of music sounds corresponding to the plurality of the music data images as the time progresses.

10. A machine readable non-transitory storage medium for use in a computer having a processor and a display device, the medium containing program instructions executable by the processor for controlling generation of music sounds with aide of the display device by processes of:

defining on the display device a loop region having an outer periphery surrounding a reference point and indicating progression of time in accordance with time information and in association with a length in a circumferential direction of the loop region;

displaying in the loop region a music data image corresponding to music data which specifies content of music sound to be generated as time progresses, wherein the music data image is displayed in the loop region such that progression of the music data corresponds to the length in the circumferential direction of the loop region;

outputting, upon receiving an instruction to start generation of the music sound, the time information indicating a time that progresses from a timing corresponding to the instruction; and generating the music sound based on the music data corresponding to the music data image and according to a relationship between a position in the circumferential direction of the loop region determined by the time information and a location of the music data image in the loop region, wherein the process of displaying displays a plurality of music data images in the loop region, and the process of generating simultaneously generates a plurality of music sounds corresponding to the plurality of the music data images as the time progresses.

11. A display control apparatus comprising:

a display control unit that defines on a display device a loop region having an outer periphery surrounding a reference point and indicating progression of time in accordance with time information and in association with a length in a circumferential direction of the loop region1 and that displays in the loop region a music data image corresponding to music data which specifies content of music sound to be generated as time progresses, wherein the music data image is displayed in the loop region such that progression of the music data corresponds to the length in the circumferential direction of the loop region.

12. The display control apparatus according to claim 11, further comprising:

a time output unit that outputs, upon receiving an instruction to start generation of the music sound1 the time information indicating a time that progresses from a timing corresponding to the instruction; and a sound generation control unit that controls the content of the music sound to be generated by a sound generation device based on the music data corresponding to the music data image and according to a relationship between a position in the circumferential direction of the loop region determined by the time information outputted by the time output unit and a location of the music data image in the loop region, wherein the display control unit performs control operation for displaying a plurality of music data images in the loop region on the display device, and the sound generation control unit performs control operation for simultaneously generating a plurality of music sounds corresponding to the plurality of the music data images as the time progresses.

13. The display control apparatus according to claim 11, wherein the display control unit performs control operation for moving one or more of the plurality of the music data images in the circumferential direction of the loop region according to an instruction so as to change relative locations among the plurality of the music data images in the loop region.

14. The display control apparatus according to claim 11, wherein the display control unit includes a zone specification unit that specifies a zone in the circumferential direction of the loop region, and wherein the content of the music sound is changed when the progression of the music data enters the zone specified by the zone specification unit.

15. The display control apparatus according to claim 11, wherein the display control unit defines a plurality of loop regions, and displays a plurality of the music data images in at least two of the plurality of the loop regions.

16. The display control apparatus according to claim 15, wherein the display control unit defines the plurality of the loop regions arranged concentric with each other around the reference point common to the plurality of the loop regions.

17. The display control apparatus according to claim 11, wherein the display control unit defines a loop region common to the plurality of the music data images, and displays the plurality of the music data images in the common loop region by different manners such that the plurality of the music data images are visually discriminated from each other.

18. The display control apparatus according to claim 11, wherein the display control unit defines a loop region having an annular shape geometrically symmetric with respect to the reference point.

19. The display control apparatus according to claim 11, wherein the display control unit displays an indicator which indicates a position in the circumferential direction of the loop region determined by the time information, such that the indicator travels in the circumferential direction of the loop region as the time progresses, and wherein the music sound is generated in looping manner as the indicator travels cyclically through the loop region.

20. A method of controlling a display device, the method comprising the steps of:

defining on the display device a loop region having an outer periphery surrounding a reference point and indicating progression of time in accordance with time information and in association with a length in a circumferential direction of the loop region; and displaying in the loop region a music data image corresponding to music data which specifies content of music sound to be generated as time progresses, wherein the music data image is displayed in the loop region such that progression of the music data corresponds to the length in the circumferential direction of the loop region.

* * * * *